United States Patent [19]

Rees

[11] Patent Number: 4,841,686

[45] Date of Patent: Jun. 27, 1989

[54] RAIN GUTTER ASSEMBLY

[76] Inventor: Herbert R. Rees, 32 Harbor View La., Toms River, N.J. 08753

[21] Appl. No.: 231,525

[22] Filed: Aug. 12, 1988

[51] Int. Cl.[4] ..... E04D 13/00

[52] U.S. Cl. ..... 52/12; 210/474

[58] Field of Search ..... 52/12; 210/474

[56] References Cited

U.S. PATENT DOCUMENTS 2,569,568 10/1951 Lipshaw .
3,420,378 7/1969 Turner .
3,630,383 12/1971 Reeves .
3,855,132 12/1974 Dugan .
4,592,174 6/1986 Hileman .
4,607,465 8/1986 Hopkins .

*Primary Examiner*—John E. Murtagh
*Assistant Examiner*—Anthony W. Williams
*Attorney, Agent, or Firm*—Martha G. Pugh

[57] ABSTRACT

This relates to an improvement for rain gutters comprising a filter attachment which is constructed to fit over the open end of the gutter. The filter attachment comprises an elongated screen to the underside of which is clamped a pad of fibrous material such as fiber glass. Adjustable clamping means is provided for holding the filter attachment in place on the gutter opening.

9 Claims, 3 Drawing Sheets

RAIN GUTTER ASSEMBLY

BACKGROUND OF THE INVENTION

This relates in general to improvements in rain gutters attached to residences and other buildings, more particularly to a method and attachment for maintaining such rain gutters free from foreign debris, such as twigs, leaves, pine needles, and the like, which tend to collect therein and clog the gutters.

Many devices, such as slotted or perforated metal sheets, or screens of wire or other material, or plastic foam, have been used in the prior art to cover the open tops of the gutters to filter out foreign material and prevent it from entering the gutter. Success with such devices has been limited because small pieces of foreign material, and even long pine needles are allowed to enter into the gutter and accumulate, thereby clogging the gutter drain, stopping the flow of water. Hence, it is still necessary at intervals to open and clean the gutter. Also, several of these prior art types of covers are difficult and time consuming to install and remove.

Accordingly, it is a principal object of the invention to provide a gutter combination or attachment which substantially eliminates the necessity to open and clean the gutter.

Another object is to provide gutter filtering means which is readily installed, and easily removed, if circumstances require it.

These, and other objects are realized in accordance with the present invention in a gutter filter attachment which comprises a screen with a coarse fiber glass lining attached to the underside of the screen. The screen is installed onto the gutter by means of resilient metal or plastic gutter straps equipped with clips which are fitted onto the end of the straps. The clip end of the gutter strap simply snaps into the screen; and the other end of the strap is bent outward, bearing against the inside rear wall of the gutter, thereby applying a downward pressure on the screen, holding it tightly against the gutter and the roof. A desired amount of pressure against the gutter and the roof may be achieved by simply adjusting the position of the clips in the screen.

The gutter filter attachment of the present invention has the advantage that it filters out even small pieces of foreign material, so that there is virtually no build-up of debris in the gutter, requiring the gutter to be periodically opened and cleaned. Another advantage of the gutter filter of the present invention is its ease of installation.

These, and other objects, features and advantages will be apparent in a study of the detailed specification hereinafter with reference to the attached drawings.

SHORT DESCRIPTION OF THE DRAWINGS

DETAILED DESCRIPTION OF THE INVENTION

Figure 2:
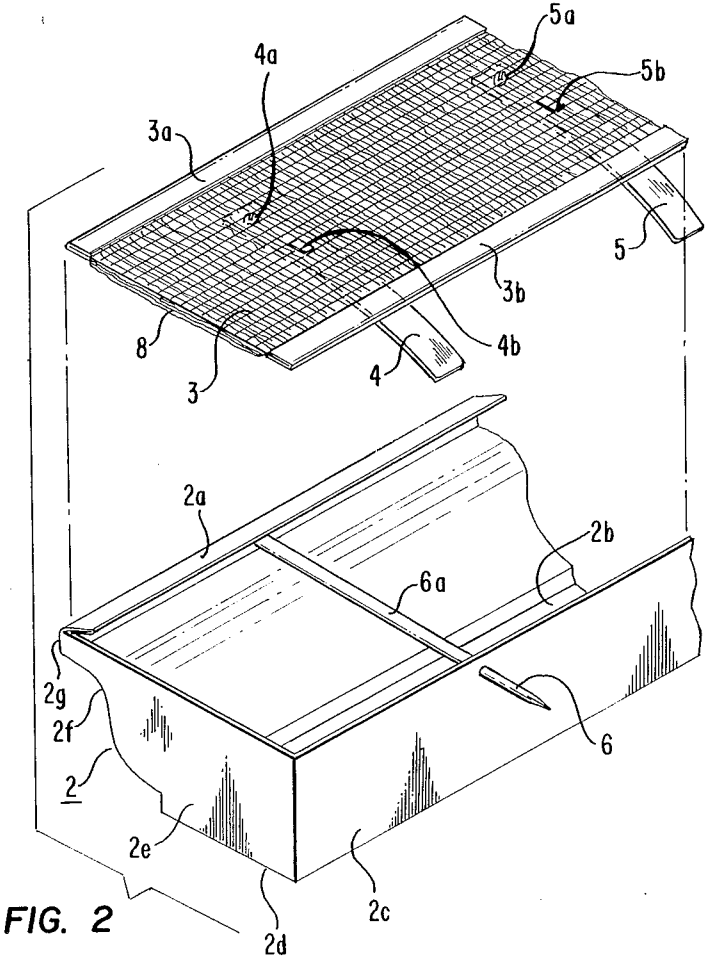
FIG. 2 is an exploded view, partially broken away, of the rain gutter filter attachment of the combination of FIG. 1 being removed from the gutter.
Figure 1:
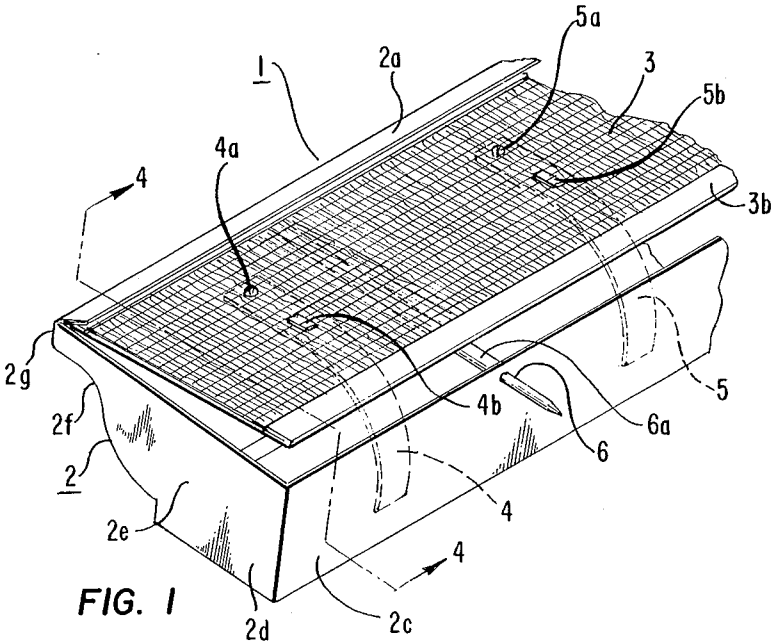
FIG. 1 is a rear perspective showing, partially broken away, of the rain gutter filter attachment of the present invention; installed on a convential gutter.
Figure 4:
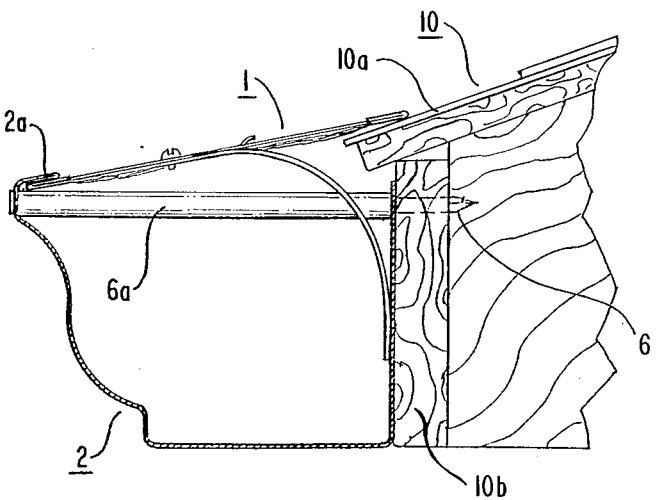
FIG. 4 is a cross-sectional view through the plane indicated by the arrows 4—4 of FIG. 1, of the rain gutter filter attachment of FIGS. 1 and 2, in place on a gutter.
Figure 3:
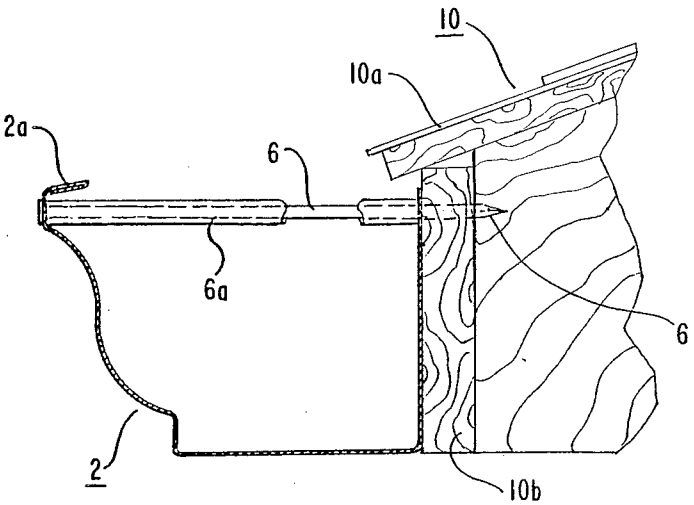
FIG. 3 is a cross-sectional view of the typical rain gutter of FIGS. 1 and 2, in place on the wall of a building.
Figure 8:
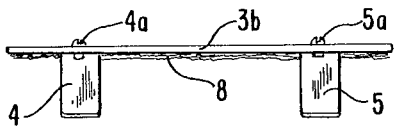
FIG. 8 is a fragmentary rear view of the filter attachment of FIGS. 1 et seq. removed from the gutter.

FIG. 1 shows a fragment of a gutter assembly as it would be disposed on the outside wall of a residence or other building. (See FIGS. 3 and 4).

In accordance with the present invention, the gutter assembly 1, as shown in FIG. 1, comprises a conventional gutter 2, preferably of sheet metal, such as aluminum. In the embodiment under description, the gutter 1 is a hollow structure comprising a flat rectangular base plate **2*d*, 3¼ inches wide, and of a length necessary to be accommodated on the sidewall 10*b* below the eaves 10*a* of a residence, or other structure, on which it is mounted. The back plate 2*c* of the gutter is of matching length, and is welded or otherwise secured, in vertical normal relation to the rear edge of the base plate 2*d*. The flat plate 2*e* at one end, and a matching plate, not shown, at the opposite end, are welded, or otherwise secured, in normal relation to the lateral edges of the base plate 2*d* and the back plate 2*c*. The side plate 2*e* is flat along the bottom edge, 3¼ inches wide, to conform to the width of base plate 2*d*, and has a curved outer wall 2*f*, which forms an outwardly projecting lip 2*g*. The elongated outwardly-curved front plate 2*h* is welded, or otherwise secured, along the front edge of the base plate 2*d*, supported at its ends beween the flat end plate 2*e* and the matching end plate on the other end. Alternatively, back plate 2*c*, base plate 2*d* and the outwardly-curved front plate 2*h*** can be formed integrally, from a single metal sheet, to form an open trough, say, 3¼ inches across the bottom, and 5 inches across the open top.

Respectively extending above the top front edge of the front lip **2*g* adjacent to the open end of the gutter 2, is a half-inch wide flange 2*a* which runs the length of the gutter, and which is constructed to fold inward flat to accommodate and hold in place the front edge of filter attachment 3-8, so that the latter completely covers the open top of gutter 2, the inner edge resting on the front edge of the roof 10*a***.

In spaced-apart positions along the length of the gutter 2, spaced-apart say, 9¼ inches, are nails 6 which pass through sleeves **6*a* disposed across the width of the gutter 2 from front to back, the ends of the nails 6 fastened into the sidewall 10*b* of the building to hold gutter 2** in place.

The screen 3, for the purposes of the present invention, may be formed of galvanized steel wire, vinyl-coated steel wire, aluminum wire, or plastic mesh. The openings may range in sizes from ¼ inch to ½ inch squares. In the present embodiment, the screen 3 is flat, just under 5 inches wide, formed of 0.028 inch diameter steel wire, woven into squares having ¼ inch openings. Screen 3 covers the full length of the gutter 2.

A particular feature of the present invention is a filter pad 8, the same length and width as the screen 3, which is fastened in contiguous relation beneath the screen, forming the filter attachment 3-8. In the present embodiment, this pad 8 is made of a layer, say, ⅜ inch thick of a material known as fiber glass. It is contemplated that the filter pad 8 may assume any thickness of between say, ⅜ inch and 1 inch for the purposes of this invention. The fiber glass pad 8 is clamped in place beneath the screen 3 along its lateral edges by means of a pair of flat elongated metal molding clamps, 3*a*, 3*b*, having upper and lower jaws, say, ½ inch wide, which, for the purposes of the present invention, may be formed of strips of aluminum, plastic, vinyl, vinly-coated steel or galvanized steel. Assembly of the screen 3 and the fiber glass pad 8, known as the 'filter attachment', is held together by the lateral molding clamps 3*a* and 3*b*. Filter attachment 3-8 is disposed to be slideably installed in place beneath the flange 2*a* so that the latter is held in place on, and completely covers the top opening of the gutter 2, with the inner edge resting on the roof 10*a*, as previously stated.

The filter attachment 3-8 is further held in place by an assembly of resilient straps and clips 4 and 5, disposed in spaced-apart relation at intervals of, say, anywhere from 8 to 12 inches, along its length.

The straps 4 and 5, and any additional straps used, depending on the length of the gutter, are formed of resilient plastic, stainless steel, or vinyl-coated spring steel, say, 1 inch wide, and 6 inches long.

Figure 10:
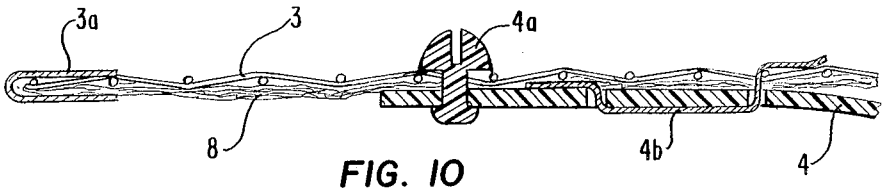
FIG. 10 is a sectional view through a plane indicated by the arrows 10—10 of FIG. 5 of the filter attachment of FIGS. 1 et seq.
Figure 9:
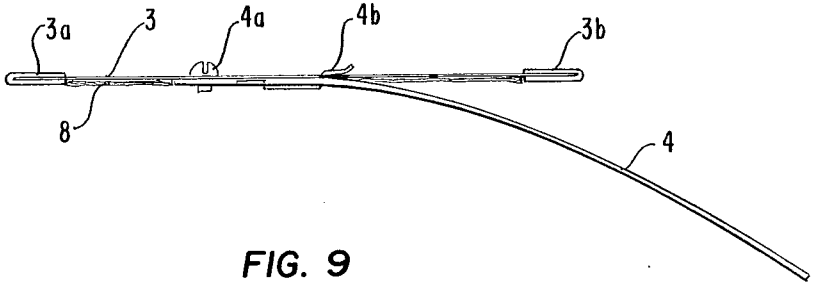
FIG. 9 is an enlarged fragment of the sectional view of FIG. 5, showing the clip joined to the filter attachment.
Figure 5:
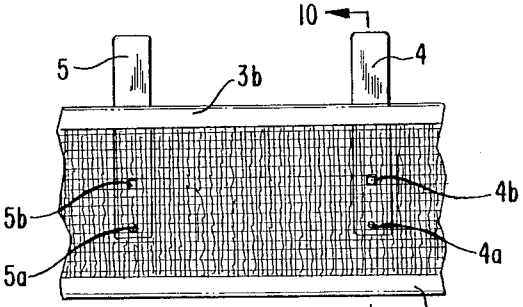
FIG. 5 is a fragmentary top view of the rain gutter filter attachment of FIGS. 1 et seq. removed from the gutter.
Figure 6:
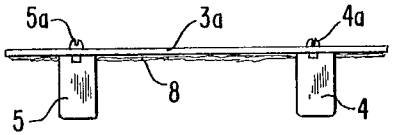
FIG. 6 is a fragmentary front view of the rain gutter filter attachment of FIGS. 1 et seq. removed from the gutter.
Figure 7:
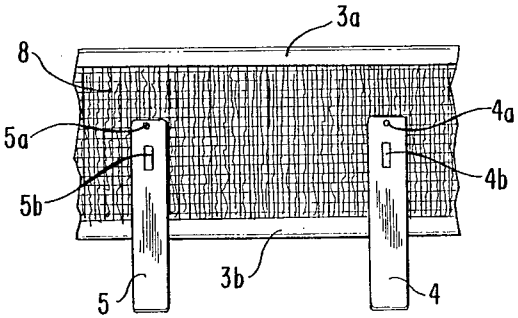
FIG. 7 is a fragmentary bottom view of the filter attachment of FIGS. 1 et seq. removed from the gutter.

Near the inner end are round screw holes which accommodate resilient snap buttons 4*a*, 5*a*, which may be formed of nylon or resilient plastic, and are snapped into place through an opening in the screen 3 to hold the upper ends of the straps 4, 5 against the underside of the screen assembly 3-8, as shown in FIG. 10. Centered in the straps 4, 5, about ½ inch beyond each of the screws 4*a*, 5*a*, are two additional parallel slots, spaced-apart, say, ½ inch, which respectively accommodate clips 4*b*, 5*b*, formed of say, stainless steel, vinyl-coated steel, or plastic, which is the same material as that of straps 4, 5. The clips 4*b*, 5*b* are say, ¼ inch wide, and are U-shaped with short flanges, extending, say, about ⅜ inch from the inner and outer ends. The clips 4*b*, 5*b* respectively fit into the two parallel slots in strips 4, 5, with the bottom of the U in contact with the under surface of straps 4, 5, so that the inner flange is secured between the underside of screen 3, and the upper face of respective strap; and outer flange extends with its free end forming a hook passing through one of the screen openings and resting on the upper surface of screen 3. Alternatively, it is contemplated that the straps 4 and 5, and the clips 4*a*, 5*a* can be formed integrally, of a single continuous piece.

When the filter attachment 3-8 has been installed in place, covering the upper opening of the gutter 2, the straps 4 and 5 bear against the rear inside wall 2*c* of the gutter 2, thereby holding the screen assembly 3-8 firmly pressed in place beneath the inwardly-directed flanges 2*a*, 2*b* which run the length of the gutter 2. It will be understood that the pressure against the inside backwall 2*c* of the gutter 2 can be varied by changing the positions of the buttons 4*a*, 5*a* and clips 4*b*, 5*b* across the width of the screen 3.

While the invention has been described with reference to a specific embodiment, it will be understood that the invention is not limited to the specific structures or dimensions described herein by way of illustration, but only as defined in the claims hereinafter.

What I claim is:

1. A rain gutter assembly for attachment to residences and other buildings which comprises in combination:

a gutter having an elongated opening constructed to be mounted along a sidewall or roof of a building to catch precipitation;

a gutter filter attachment constructed to cover said opening along the length of said gutter;

said filter attachment comprising in combination a screen;

a pad of fiberous material mounted on the underside of said screen substantially along the length and width of said gutter; and clamping means attachable to said filter attachment for holding said filter attachment removably in place to cover the opening of said gutter.

2. A rain gutter assembly in accordance with claim 1 wherein said pad of fibrous material consists essentially of fiber glass.

3. A rain gutter assembly in accordance with claim 1 wherein said clamping means comprises one or more straps of flexible resilient material having one end removably fastened to the underside of said filter attachment, and said one or more straps each having a free end protruding from the rear end of said filter attachment, and being constructed to bear against the inside rear wall of said rain gutter.

4. A subcombination of a rain gutter assembly which comprises in combination a gutter filter attachment constructed to cover an opening along the length of a rain gutter;

said filter attachment comprising in combination a screen;

a pad of fibrous material mounted on the underside of said screen substantially along the length and width of said screen; and clamping means attached to said filter attachment for holding said filter attachment removably in place over the opening of said rain gutter.

5. A subcombination of a rain gutter assembly in accordance with claim 4 comprising a filter attachment wherein said fibrous material consists essentially of fiber glass.

6. A subcombination of a rain gutter assembly in accordance with claim 4 comprising a filter attachment wherein said clamping means comprises one or more straps of flexible resilient material having one end removably fastened to the underside of said filter attachment, and said one or more straps each having a free end protruding from the rear of said filter attachment, and being constructed to bear against the inside rear wall of said gutter.

7. The combination in accordance with claim 6 wherein said straps are of a resilient strip consisting essentially of metal or plastic.

8. The combination in accordance with claim 6 wherein said clamping means comprise longitudinal molding strips along the length of the edges of said filter attachment for securing said pad of fibrous material in place beneath said screen.

9. The combination in accordance with claim 1 wherein said clamping means comprises a longitudinal flange folded inward along the front edge of said gutter;

and longitudinal molding strips are disposed along the length of the edges of said filter attachment for securing said pad of fibrous material in place beneath said screen; and wherein said filter attachment is slideably accommodated beneath said longitudinal flange along the front edge of said gutter.

* * * * *